US006253592B1

(12) United States Patent
Sakurai et al.

(10) Patent No.: US 6,253,592 B1
(45) Date of Patent: Jul. 3, 2001

(54) ROLLING APPARATUS FOR BARS AND METHOD FOR ROLLING BARS

(75) Inventors: Tomoyasu Sakurai; Takao Ogawa, both of Kurashiki (JP)

(73) Assignee: Kawasaki Steel Corporation, Hyogo (JP)

( * ) Notice: Subject to any disclaimer, the term of this patent is extended or adjusted under 35 U.S.C. 154(b) by 0 days.

(21) Appl. No.: 09/511,997

(22) Filed: Feb. 24, 2000

(30) Foreign Application Priority Data

Mar. 12, 1999 (JP) ..... 11-065847

(51) Int. Cl.[7] ..... B21B 39/08
(52) U.S. Cl. ..... 72/205
(58) Field of Search ..... 72/205, 203, 249

(56) References Cited

U.S. PATENT DOCUMENTS 4,379,395 * 4/1983 Konishi et al. ..... 72/203
4,706,479 * 11/1987 Tominaga ..... 72/205

FOREIGN PATENT DOCUMENTS 57-72716 5/1982 (JP) .
61-226108 10/1986 (JP) .

* cited by examiner

*Primary Examiner*—Rodney A. Butler
(74) *Attorney, Agent, or Firm*—Oliff & Berridge, PLC

(57) ABSTRACT

A high-speed rolling apparatus for bars includes a finishing mill and an associated first mill motor and a sizing mill and an associated second mill motor downstream of the finishing mill. The first mill motor power (Wf) and second mill motor power (Ws) satisfy the expression: Wf/Ws≧5. The apparatus provides simple and highly accurate control of the tension that is applied to the bars between the finishing mill and the sizing mill.

6 Claims, 2 Drawing Sheets

ROLLING APPARATUS FOR BARS AND METHOD FOR ROLLING BARS

BACKGROUND OF THE INVENTION

1. Field of Invention

The present invention relates to rolling apparatuses for bars. In particular, the present invention relates to a high-speed rolling apparatus for bars, which can provide simple, easy, and highly accurate tension-control. The tension is applied to the bars between a finishing mill and a sizing mill provided downstream from the finishing mill. The bars can have various shapes and can include reinforcing wire rods.

2. Description of Related Art

In general, bars are produced by rolling processes including rough rolling, intermediate rolling, finish rolling by a finishing mill including a plurality of roll stands, and a sizing rolling by a sizing mill including a plurality of roll stands.

In these bar rolling processes, the tension that is applied to the bars between each mill must be controlled so that breakage and buckling do not occur during rolling. Accurate tension-control is particularly important in high-speed rolling.

Methods for controlling tension are known, such as a method for controlling motor current of mill stands and another method that uses a looper.

A method for controlling motor current of mill stands is disclosed, for example, in Japanese Unexamined Patent Application Publication Nos. Sho-57-72716 and Sho-61-226108. In this method, the motor current applied for roll stand control is regulated so that the motor current is set to provide a tensionless state when the bar is engaged by a roll stand of the subsequent process. The motor current to provide a tensionless state is obtained by storing a current value before the roll stand of the following process engages the bar. This method is called the "current memory method".

However, it is very difficult to practice high-speed rolling by using the current memory method. For example, when the distance between each mill is 10 meters and the bar runs at a high speed of 100 m/s, the current for providing a tensionless state must be applied in less than 0.1 second, which is practically impossible to achieve.

Another known method is the "torque arm memory method." In this method, the tension applied to the bars is obtained from a torque arm value of the roll axle, which is obtained from a rolling torque obtained by a current value varying according to rolling resistance, and a rolling reactive force (actual value) detected by a detector of the mill for detecting rolling load. In the torque arm memory method, a looper sets the torque arm value to a proper value for controlling the bar tension directly.

However, in methods that use a looper, the looper cannot follow the high-speed transfer of a material such as a bar for control purposes, which is at more than 100 meters per second.

Moreover, it is difficult to use a rolling load detector, which is used in the torque arm memory method, in a planetary cross rolling mill (which includes conical rolls that rotate and revolve) generally used for rolling bars. It is difficult to use such rolling load detectors due to higher costs because precise measuring and controlling technologies are required to use them.

SUMMARY OF THE INVENTION

Accordingly, it is an object of the present invention to provide a rolling apparatus that can achieve highly accurate tension control by only a very simple facility improvement.

It is also an object of the present invention to provide a rolling method that utilizes the rolling apparatus.

The present invention can be applied to a rolling apparatus for bars that includes a sizing mill downstream of a finishing mill.

The rolling apparatus can be a high-speed rolling apparatus that conveys the bars at a speed, for example, of at least about 100 m/s.

This invention is achieved by considering the relationship of motor power between a finishing mill and a sizing mill. Highly accurate tension control is enabled by changing the relationship of the motor power while avoiding problems caused thereby. The motor power is determined according to the capacity of electrical facilities, in which the most upstream sizing mill motor is provided having less power than the finishing mill motor, so that a small tension variation can be converted to a large variation in the electric current of motors. The highly accurate tension control can be performed, according to the invention, by using a method in which the current applied to a mill motor in a sizing mill is controlled to a desired value.

A rolling apparatus for bars according to an exemplary embodiment of the present invention comprises a finishing mill, a mill motor that drives the finishing mill, a most upstream sizing mill downstream of the finishing mill, and a mill motor that drives the sizing mill. In the rolling apparatus, the finishing mill motor power (Wf) and the most upstream sizing mill motor power (Ws) satisfy the following expression: $Wf/Ws \geqq 5$.

A method for rolling bars according to another exemplary embodiment of the present invention utilizes a rolling apparatus including a finishing mill and an associated mill motor, and a sizing mill downstream of the finishing mill and having an associated mill motor. The finishing mill motor power (Wf) and the most upstream sizing mill motor power (Ws) satisfy the following expression: $Wf/Ws \geqq 5$. The method for rolling bars comprises controlling a tensile force applied to the bars by controlling an electric current applied to the mill motor that drives the sizing mill.

DETAILED DESCRIPTION OF PREFERRED EMBODIMENTS

The present invention is applied to a rolling apparatus for bars including a sizing mill downstream of a finishing mill. The present invention is achieved as a result of discovering that the ratio of the finishing mill motor power (Wf) to the most upstream sizing mill motor power (Ws), i.e., Wf/Ws, is most preferably five or greater.

As described herein, the "finishing mill motor" is a motor that drives a plurality of roll stands of the finishing mill. Further, as described herein, the "most upstream sizing mill motor" drives a plurality of the roll stands, including the most upstream roll stand, used in the subsequent processes.

Figure 1:
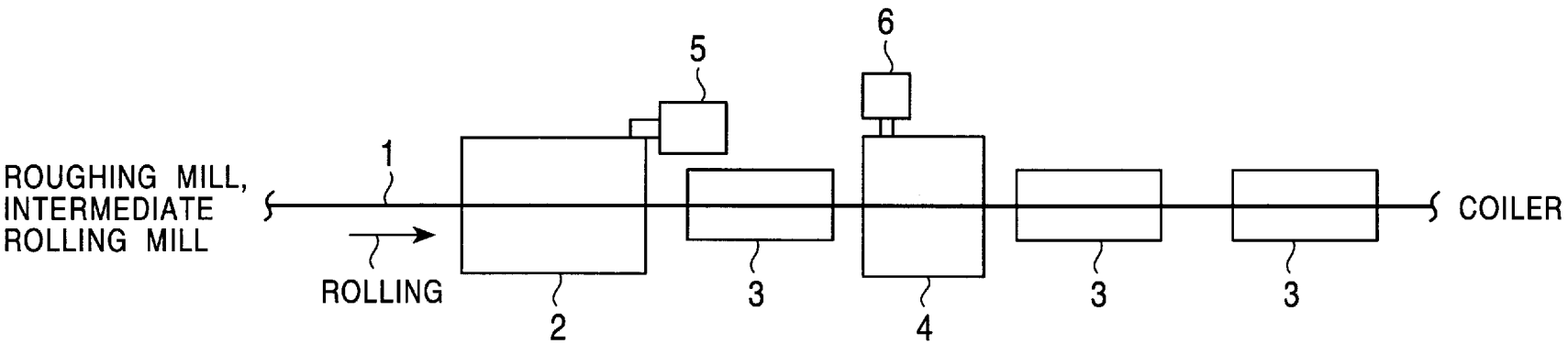
FIG. 1 is a block diagram of a bar rolling line.

An exemplary embodiment according to the invention is described below, in which the present invention is applied to a bar rolling apparatus including a bar rolling line as shown in FIG. 1.

In the bar rolling line shown in FIG. 1, a bar 1 is rolled by a finish-rolling mill 2, cooled by passage through a first water-cooling zone 3, and sizing-rolled by a most-upstream sizing mill 4. Then, the bar 1 is cooled to a desired temperature by passage through a second water-cooling zone 3, and coiled by a coiler. The finish-rolling mill 2 is driven by a mill motor 5, and the most upstream sizing mill 4 is driven by a mill motor 6.

Tension is applied to the bar 1 in a position between each mill to avoid breakage and buckling of the bar 1 while the bar 1 is being rolled. The tension varies according to conditions such as the temperature of the bar 1.

The present inventors have discovered that there is a tension variation generated between the finishing-rolling mill 2 and the sizing mill 4, and further that this tension variation is the most significant cause of the breakage and buckling of bars.

Breakage of bars is likely to occur when a positive tension is great, which is applied to a bar between the finishing mill and the sizing mill. That is, breakage is likely to occur when a tensile force is applied to the bar. When the tension is great, the current of the most upstream sizing mill motor increases, while the current of the finishing mill motor does not significantly change. Therefore, the current of the most upstream sizing mill motor must be controlled so that it decreases in order to avoid such breakage.

Buckling of bars is likely to occur when a negative tension is great. That is, buckling is likely to occur when a compressive force is applied to the bar. When the negative tension is great in contrast to the increased positive tension, the current of the most upstream sizing mill motor must be controlled so that it increases in order to avoid such buckling.

As stated above, in exemplary embodiments of the invention, the following expression is preferably satisfied: $Wf/Ws \geqq 5$.

As the cross-sectional area of a bar decreases, a corresponding suitable tension value progressively decreases to avoid both breakage and buckling of the bar. Therefore, a mill current has a minimum value for obtaining the lowest permissible tension for avoiding breakage and buckling of a bar having the smallest cross-sectional area that is practically obtainable.

The lowest permissible tension for avoiding both breakage and buckling of a bar having a diameter of 5 mm or more is known empirically to be in the range of $+0.5 \pm 0.1$ kgf/mm$^2$.

Figure 2:
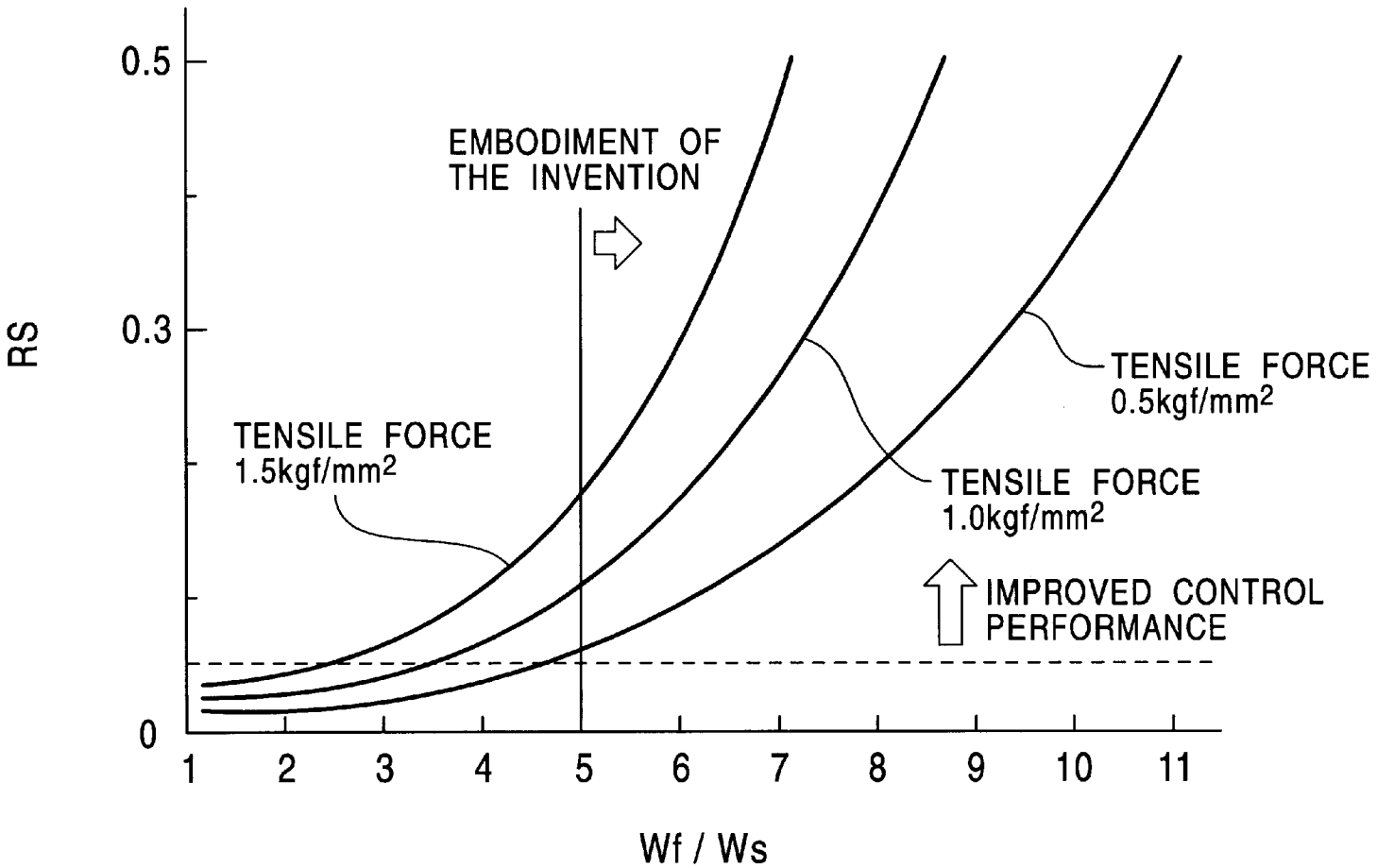
FIG. 2 is a graph showing the relationship, in accordance with tension, between a ratio (Wf/Ws) of the finishing mill motor power (Wf) to the most upstream sizing mill motor power (Ws), and a current ratio (RS) of the most upstream sizing mill motor.

FIG. 2 shows the relationship, in accordance with the tension to the bar having a diameter of 5.5 mm, between a ratio (Wf/Ws) of the finishing mill motor power (Wf) to the most upstream sizing mill motor power (Ws), and a current ratio (RS) of the most upstream sizing mill motor. The "current ratio" is the current value when tension is applied minus the current value when tension is not applied, divided by the rated current value.

As the motor power ratio (Wf/Ws) increases, the current ratio (RS) at a certain tension value further increases, thereby increasing a controlling range of the current ratio (RS) for controlling tension, whereby the control becomes easier. The motor power ratio (Wf/Ws) must be greater than five, because the current ratio is preferably greater than 0.05 for the smooth control of electric current.

The above-described fact is applicable to the case in which one most upstream sizing mill motor drives only the most upstream roll stand in the sizing mill, or more than one roll stand, including the most upstream roll stand in the sizing mill.

This feature of the present invention was confirmed by an experiment performed in the bar rolling line shown in FIG. 1.

Downstream of a rough rolling mill and an intermediate rolling mill, there were disposed a finishing mill including ten roll stands each having two rolls, a first water-cooling zone, a sizing mill including three roll stands each having four rolls, and a second water-cooling zone. A bar having a diameter of 7 mm was rolled, in which a mill motor included in the most upstream stand drove four rolls of one of the roll stands in the most upstream of the sizing mill, and the motor power ratio (Wf/Ws) was set to 11.5 (Wf=6000 KW, Ws=520 KW), for controlling the tensile force in the range of $0.5 \pm 0.1$ kgf/mm$^2$. As a result, the current ratio (RS) of the most upstream sizing mill motor could be in the range of $0.5 \pm 0.1$, whereby breakage and buckling of the bar could be easily avoided, the rate of incidence of breakage and buckling being zero.

A bar having the same diameter of 7 mm was rolled, in which the motor power ratio (Wf/Ws) was set to 2.22 (Wf=1000 KW, Ws=450 KW), for controlling the tensile force in the range of $0.5 \pm 0.1$ kgf/mm$^2$. As a result, the current ratio (RS) was $0.015 \pm 0.005$, in which breakage and buckling often occurred, and the rate of incidence of breakage and buckling was 10%.

As a result of the above-described experiment, a highly accurate tension control was found to be realized by applying the present invention to a bar rolling mill.

What is claimed is:

1. A method for rolling bars using a rolling apparatus including a finishing mill, a first mill motor that drives the finishing mill, a most upstream sizing mill downstream of the finishing mill, and a second mill motor that drives the most upstream sizing mill, the first mill motor power (Wf) and the second mill motor power (Ws) satisfy the expression: $Wf/Ws \geqq 5$, the method comprising:

controlling a tensile force applied to the bars during rolling by controlling an electric current applied to the second mill motor that drives the sizing mill.

2. The method of claim 1, further comprising applying the tensile force to the bars to prevent buckling or breakage of the bars during rolling.

3. The method of claim 1, further comprising conveying the bars with the rolling apparatus at a speed of at least 100 m/s.

4. A method for rolling bars using a rolling apparatus including a finishing mill, a first mill motor that drives the finishing mill, a most upstream sizing mill downstream of the finishing mill, and a second mill motor that drives the most upstream sizing mill, the method comprising:

controlling a ratio Wf/Ws between the first mill motor power (Wf) and the second mill motor power (Ws); and controlling a tensile force applied to the bars during rolling by controlling an electric current applied to the second mill motor, wherein the bars are prevented from buckling or breakage during rolling.

5. The method of claim 4, further comprising conveying the bars with the rolling apparatus at a speed of at least 100 m/s.

6. A rolling apparatus for bars, comprising:

a finishing mill;

a first mill motor that drives the finishing mill;

a most upstream sizing mill downstream of the finishing mill; and a second mill motor that drives the most upstream sizing mill;

wherein the first mill motor power (Wf) and the second mill motor power (Ws) satisfy the expression: $Wf/Ws \geqq 5$.

* * * * *